US012152336B2

(12) United States Patent
Seo et al.

(10) Patent No.: US 12,152,336 B2
(45) Date of Patent: Nov. 26, 2024

(54) LAUNDRY TREATMENT APPARATUS

(71) Applicant: LG Electronics Inc., Seoul (KR)

(72) Inventors: Minsoo Seo, Seoul (KR); Heechoul Jung, Seoul (KR); Hyeri Ryu, Seoul (KR)

(73) Assignee: LG Electronics Inc., Seoul (KR)

( * ) Notice: Subject to any disclaimer, the term of this patent is extended or adjusted under 35 U.S.C. 154(b) by 359 days.

(21) Appl. No.: 17/592,963

(22) Filed: Feb. 4, 2022

(65) Prior Publication Data

US 2022/0251772 A1 Aug. 11, 2022

(30) Foreign Application Priority Data

Feb. 5, 2021 (KR) ..... 10-2021-0016699

(51) Int. Cl.

| | |
|---|---|
| ***D06F 25/00*** | (2006.01) |
| ***D06F 37/00*** | (2020.01) |
| ***D06F 37/26*** | (2006.01) |
| ***D06F 58/02*** | (2006.01) |
| ***D06F 58/04*** | (2006.01) |
| ***D06F 58/20*** | (2006.01) |
| ***D06F 58/26*** | (2006.01) |

(52) U.S. Cl.

CPC ..... *D06F 58/26* (2013.01); *D06F 37/00* (2013.01); *D06F 37/267* (2013.01); *D06F 58/02* (2013.01); *D06F 58/04* (2013.01); *D06F 58/20* (2013.01); *D06F 58/263* (2013.01); *D06F 25/00* (2013.01)

(58) Field of Classification Search

None

See application file for complete search history.

(56) References Cited

U.S. PATENT DOCUMENTS

2008/0244922 A1* 10/2008 Kim ..... D06F 58/26 34/235

FOREIGN PATENT DOCUMENTS

| | | |
|---|---|---|
| CN | 105316890 | 2/2016 |
| CN | 105316891 | 2/2016 |
| CN | 109082822 | 12/2018 |
| CN | 109137376 | 1/2019 |
| EP | 2868792 | 5/2015 |
| EP | 2886705 | 6/2015 |
| JP | 2011-194035 | 10/2011 |
| WO | WO2006095935 | 9/2006 |
| WO | WO2007021134 | 2/2007 |
| WO | WO2010100114 | 9/2010 |

OTHER PUBLICATIONS

Extended European Search Report in European Appln. No. 22152218.8, dated Jul. 21, 2022, 8 pages.

Office Action in Chinese Appln. No. 202210105007.4, mailed on Mar. 31, 2023, 27 pages(with English translation).

* cited by examiner

*Primary Examiner* — Levon J Shahinian

(74) *Attorney, Agent, or Firm* — Fish & Richardson P.C.

(57) ABSTRACT

A laundry treatment apparatus includes a cabinet defining an appearance thereof, a tub disposed in the cabinet, a drum rotatably disposed in the tub, and an air supply unit configured to heat and circulate air in the tub, the air supply unit including a fan duct coupled to an air collection port provided at the tub so as to collect the air in the tub, a heating duct fixed to an upper portion of the tub and coupled to the fan duct so as to heat air supplied from the fan duct and to guide the air in a forward direction of the tub, and a supply duct coupled to the heating duct so as to supply air in a forward direction of the tub.

18 Claims, 11 Drawing Sheets

A - A'

LAUNDRY TREATMENT APPARATUS

CROSS-REFERENCE TO RELATED APPLICATION

This application claims the benefit of Korean Patent Application No. 10-2021-0016699, filed on Feb. 5, 2021, which is hereby incorporated by reference as if fully set forth herein.

TECHNICAL FIELD

The present disclosure is a laundry treatment apparatus, and more particularly to a laundry treatment apparatus which includes an improved air supply unit configured to supply hot air to a tub.

BACKGROUND

Generally, examples of a laundry treatment apparatus may include a washing machine, a combined drying and washing machine and the like. Among these, the washing machine is a product configured to eliminate various contaminants from clothes or bedclothes using emulsification, rubbing action caused by flow of water generated by rotation of a pulsator or a drum, and impact action applied to the laundry. Full automatic washing machines, which are developed recently, are designed to automatically perform a series of procedures of a washing course, a rinsing course, a dewatering course and the like without intervention of manipulation of a user.

The combined drying and washing machine is a kind of washing machine, which is designed to perform not only the function of the above-mentioned washing machine but also a function of drying laundry after the washing of the laundry. An example of the combined drying and washing machine is a condensation-type washing dryer, which is operated in such a way as to take air out of a tub, remove moisture from the air through condensing water, heat the air, and return the heated air to the tub again.

Accordingly, a conventional condensing-type combined drying and washing machine will be briefly described. The combined drying and washing machine includes a cabinet defining a reception space therein, a tub disposed in the cabinet, a drum rotatably provided in the tub, and an air supply unit configured to dehumidify and heat air containing moisture, taken out of the tub ant to supply the air to the tub again.

The air supply unit of the conventional combined drying and washing machine includes a duct provided at an upper portion of the tub so as to suck air from the tub. The duct includes therein a blowing fan configured to suck air from the inside of the duct, and a heater configured to heat the air blown by the blowing fan. Typically, the duct, which is provided therein with the blowing fan and the heater, is integrally formed.

The tub of the combined drying and washing machine may have a different size depending on the capacity of the combined drying and washing machine, and the duct of the air supply unit, which is provided at the tub, must also have a different size depending on the size of the tub.

Accordingly, the combined drying and washing machine must have ducts of the air supply unit corresponding to various sizes of the tub. Hence, there is a problem in which manufacturing costs increase in order to separately manufacture the ducts corresponding to the various sizes of the tub.

Accordingly, there is a recent need for ducts of an air supply unit capable of corresponding to tubs of combined drying and washing machines having various capacities.

SUMMARY

Therefore, the present disclosure has been made in view of the above problems, and it is an object of the present disclosure to provide a laundry treatment apparatus equipped with a duct capable of corresponding to tubs having various sizes by improving the structure of an air supply unit provided at a combined drying and washing machine.

Furthermore, the present disclosure has been made in view of the above problems, and it is another object of the present disclosure to provide a laundry treatment apparatus equipped with a duct capable of corresponding to tubs having various sizes by separately modularizing a heat and a blowing fan of an air supply unit provided at a combined drying and washing machine.

The objects of the present disclosure are not limited to the above-mentioned objects, and other objects of the present disclosure, which are not mentioned above, will be clearly understood to those skilled in the art from the following descriptions.

In order to accomplish the above objects, an aspect of the present disclosure provides a laundry treatment apparatus including a cabinet defining an appearance thereof, a tub disposed in the cabinet, a drum rotatably disposed in the tub, and an air supply unit configured to heat and circulate air in the tub, the air supply unit including a fan duct coupled to an air collection port provided at the tub so as to collect the air in the tub, a heating duct fixed to an upper portion of the tub and coupled to the fan duct so as to heat air supplied from the fan duct and to guide the air in a forward direction of the tub, and a supply duct coupled to the heating duct so as to supply air in a forward direction of the tub.

The fan duct may include an outflow port configured to guide air toward the heating duct, and the heating duct may include an inflow port coupled to the outflow port of the fan duct.

The outflow port may be provided at an outer side thereof with a first coupler, and the inflow port may be provided at an outer side thereof with a second coupler corresponding to the first coupler, the fan duct and the heating duct defining an air passage therebetween when the first coupler and the second coupler are coupled to each other.

The first coupler may include a first rotatable coupler, which is provided at one side of the outflow port and has a flat surface parallel to a direction in which the fan duct is coupled, and a first fixing coupler, which is provided at a remaining side of the outflow port and has a flat surface parallel to the outflow port.

The second coupler may include a second rotatable coupler, which is provided at one side of the inflow port and has a flat surface parallel to a direction in which the fan duct is coupled and to which the first rotatable coupler is rotatably coupled, and a second fixing coupler, which has a flat surface parallel to the inflow port and to which the first fixing coupler is fixed.

The fan duct may include a lower fan duct, which is coupled to the air collection port and is provided with a fan housing in which a blowing fan configured to blow air is mounted, and an upper fan duct coupled to an upper portion of the lower fan duct and provided with a motor configured to transmit rotational force to the blowing fan.

The heating duct may include a box-shaped lower heating duct, which is fixed to an upper surface of the tub and is open at an upper surface thereof, and an upper heating duct mounted on the lower heating duct so as to define an air passage.

The outflow port may include a lower outflow port formed at the lower fan duct and an upper outflow port formed at the upper fan duct, and the inflow port may include a lower inflow port, which is formed at the lower heating duct and is in contact with the lower outflow port, and an upper inflow port, which is formed at the upper heating duct and is in contact with the upper outflow port.

The lower outflow port may be provided in an end thereof with a sealing groove, which extends along the end of the lower outflow port and into which a seal is inserted, and the lower inflow port may be provided in an end thereof with a press step, which is inserted into the sealing groove so as to press the seal.

The upper outflow port may be provided on an upper surface thereof with a sealing step, which is inserted downwards into the upper inflow port and to which a seal is attached, and the upper inflow port may be provided on a lower surface thereof with a press surface configured to press the seal.

The lower heating duct may include a lower wall defining an air passage, the lower wall having a heater coupler to which a heater unit configured to heat air in the heating duct is mounted.

The heater unit may include a heater bracket inserted into the heater coupler and fixed thereto, and a heater coil, which is supported by the heater bracket and extends into the heating duct.

The lower wall may have a sealing groove formed in an upper surface thereof, a seal being inserted into the sealing groove so as to create a sealing state in cooperation with the upper heating duct, and the heater bracket may have an extending groove formed in an upper surface thereof so as to extend from the sealing groove, the seal being inserted into the extending groove.

The lower heating duct may include a lower wall defining an air passage, the lower wall having a sensor coupler to which a sensor unit configured to detect temperature of air in the heating duct is mounted.

The sensor unit may include a sensor bracket inserted into the sensor coupler and fixed thereto, and a sensor, which is supported by the sensor bracket and extends into the heating duct.

The lower wall may have a sealing groove formed in an upper surface thereof, a seal being inserted into the sealing groove so as to create a sealing state in cooperation with the upper heating duct, and the sensor bracket may have an extending groove formed in an upper surface thereof so as to extend from the sealing groove, the seal being inserted into the extending groove.

In order to accomplish the above objects, another aspect of the present disclosure provides a laundry treatment apparatus including a cabinet defining an appearance thereof, a tub disposed in the cabinet, a drum rotatably disposed in the tub, and an air supply unit configured to heat and circulate air in the tub, the air supply unit including a fan duct coupled to an air collection port provided at the tub so as to collect the air in the tub, a heating duct fixed to an upper portion of the tub and coupled to the fan duct so as to heat air supplied from the fan duct and to guide the air in a forward direction of the tub, and a supply duct coupled to the heating duct so as to supply air in a forward direction of the tub, wherein the fan duct includes a lower fan duct, which is coupled to the air collection port and is provided with a fan housing in which a blowing fan configured to blow air is mounted, and an upper fan duct coupled to an upper portion of the lower fan duct and provided with a motor configured to transmit rotational force to the blowing fan, and wherein the heating duct includes a box-shaped lower heating duct, which is fixed to an upper surface of the tub and is open at an upper surface thereof, and an upper heating duct mounted on the lower heating duct so as to define an air passage.

The fan duct may include an outflow port configured to guide air toward the heating duct, and the heating duct may include an inflow port coupled to the outflow port of the fan duct, wherein the outflow port includes a lower outflow port formed at the lower fan duct and an upper outflow port formed at the upper fan duct, and wherein the inflow port includes a lower inflow port, which is formed at the lower heating duct and is in contact with the lower outflow port, and an upper inflow port, which is formed at the upper heating duct and is in contact with the upper outflow port.

The lower outflow port may be provided in an end thereof with a sealing groove, which extends along the end of the lower outflow port and into which a seal is inserted, the lower inflow port may be provided in an end thereof with a press step, which is inserted into the sealing groove so as to press the seal, the upper outflow port may be provided on an upper surface thereof with a sealing step, which is inserted downwards into the upper inflow port and to which a seal is attached, and the upper inflow port may be provided on a lower surface thereof with a press surface configured to press the seal.

The outflow port may be provided at an outer side thereof with a first coupler, and the inflow port may be provided at an outer side thereof with a second coupler corresponding to the first coupler, wherein the first coupler includes a first rotatable coupler, which is provided at one side of the outflow port and has a flat surface parallel to a direction in which the fan duct is coupled, and a first fixing coupler, which is provided at a remaining side of the outflow port and has a flat surface parallel to the outflow port, and wherein the second coupler may include a second rotatable coupler, which is provided at one side of the inflow port and has a flat surface parallel to a direction in which the fan duct is coupled and to which the first rotatable coupler is rotatably coupled, and a second fixing coupler, which has a flat surface parallel to the inflow port and to which the first fixing coupler is fixed.

DETAILED DESCRIPTION

In the description of the present disclosure, the names of components disclosed in this closure are defined in consideration of functions in the present disclosure. Accordingly, the names of the components should not be construed as being limited to the components. Furthermore, the names defining the components may be referred to as other names in a relevant technical field.

Hereinafter, a laundry treatment apparatus according to an embodiment of the present disclosure will be described in detain with reference to the accompanying drawings.

Figure 1:
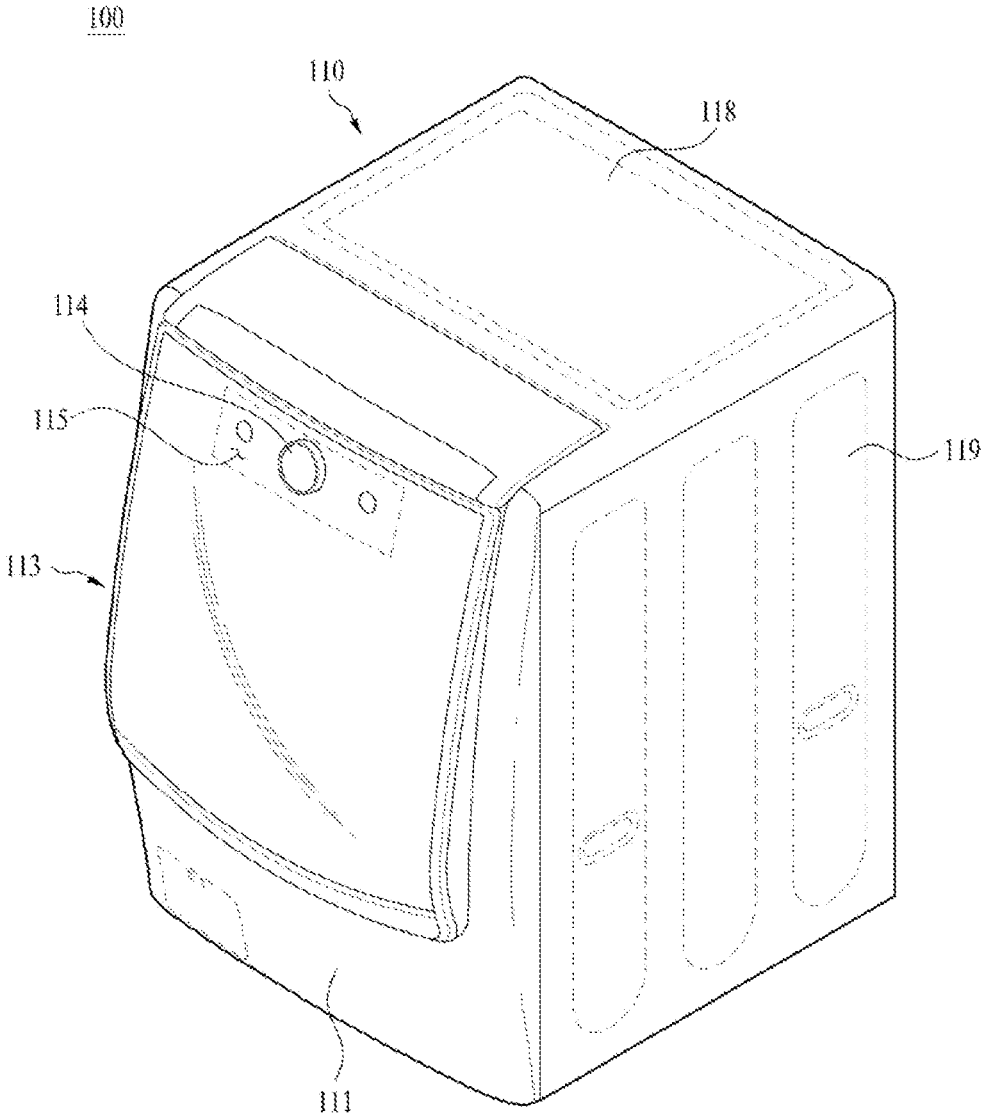
FIG. 1 is a perspective view illustrating a laundry treatment apparatus according to the present disclosure.
Figure 2:
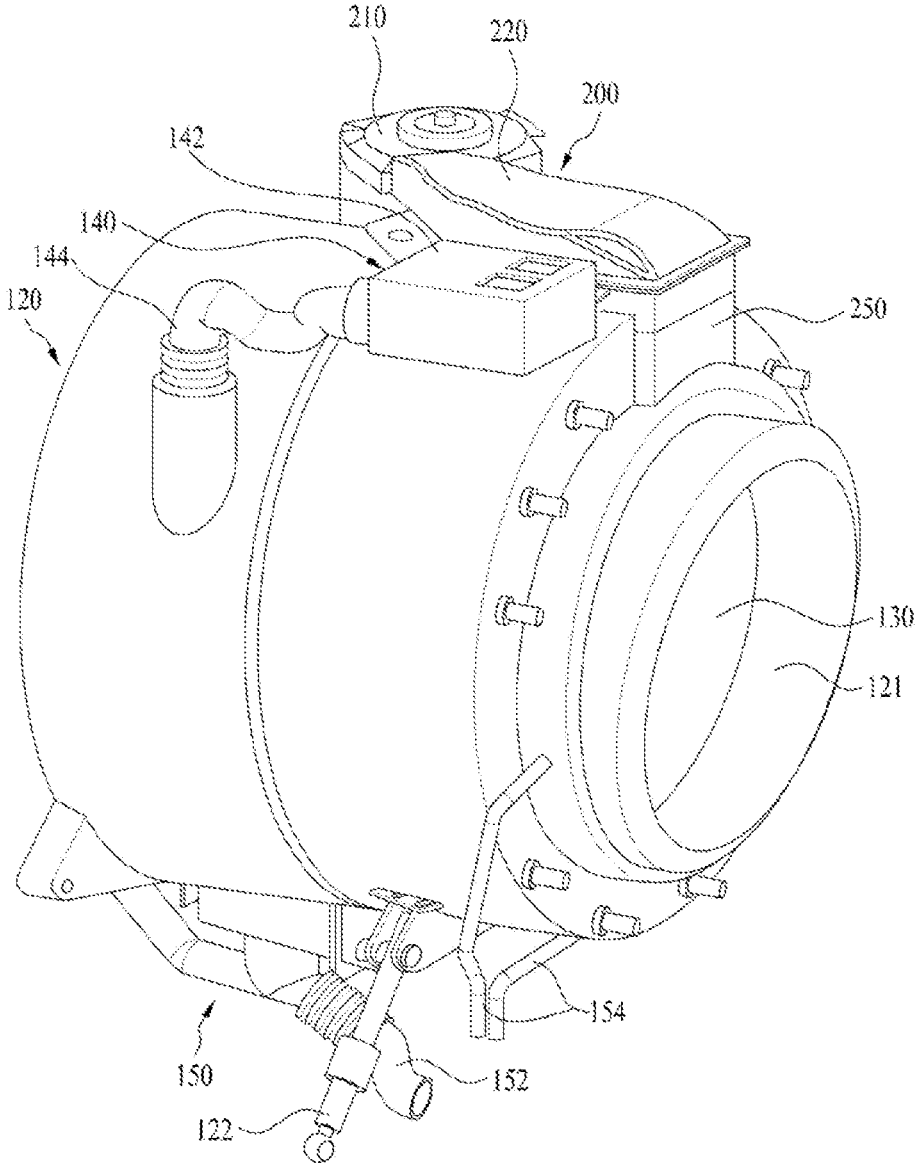
FIG. 2 is a perspective view illustrating the internal construction of the laundry treatment apparatus according to the present disclosure.

FIG. 1 is a perspective view illustrating the laundry treatment apparatus according to the present disclosure. FIG. 2 is a perspective view illustrating the internal construction of the laundry treatment apparatus according to the present disclosure.

As illustrated in FIGS. 1 and 2, the laundry treatment apparatus 100 according to an embodiment of the present disclosure includes a cabinet 110 defining the appearance thereof, a tub 120 disposed in the cabinet 110 so as to store washing water, a drum 130 rotatably disposed in the tub 120 in the axial direction thereof, a water supply unit 140, which is connected to an external water supply source (not shown) and supplies the washing water or mixture of the washing water and detergent to the tub 120, a water discharge unit 150 configured to discharge the washing water, which has been completely used in washing in the tub 120, and an air supply unit 200 including a fan duct 210 disposed above the tub 120 so as to suck the air in the tub 120 and a heating duct 220 configured to heat the air that is flowed by the fan duct 210.

The cabinet 110 defines the appearance of the laundry treatment apparatus 100 according to the embodiment, and is provided therein and thereon with various components, which will be described later. The cabinet 110 may be composed of a front cabinet 111, a side cabinet 117, an upper cabinet 118, and a rear cabinet (not shown).

Here, the front cabinet 111 is provided at the front side thereof with an entrance (not shown), through which laundry is introduced, and a door 113, which is rotatable so as to open and close the entrance. Furthermore, a manipulator 114 configured to control the laundry treatment apparatus 100 and a display 115 may be provided at the upper portion of the front cabinet 111 or the front surface of the door 113.

The tub 120 is movably supported by a spring (not shown) or a damper 122 inside the cabinet 110, and the tub stores therein washing water supplied from the water supply unit 140. The tub 120 is configured to have the form of a box, which is provided at the front side thereof with an entrance 121 through which laundry is introduced into the drum 130 and which opens the door 113.

The entrance 121 is provided at the outer circumference thereof with a rim 121*a* projecting forwards from the tub 120. The rim 121*a* is connected to a supply duct 250 of the air supply unit 200, which will be described later. A drive motor 219*a* is mounted on the rear surface of the tub 120 so as to rotate the drum 130. The rotational speed of the drive motor 219*a* is controlled by a controller (not shown). Because the structures and the kinds of the drive motor 219*a* are well known in those skilled in the art and various embodiments thereof are possible, detailed description thereof is omitted.

The tub 120 is resiliently supported by the upper spring (not shown) and the lower damper 122. Consequently, when vibrations generated when the drum 130 is rotated by the drive motor 219*a* is transmitted to the cabinet 110 via the tub 120, the vibrations are buffered and diminished by means of the spring and the damper 122, thereby diminishing the transmission of the variations caused by the rotation of the drum 130 to the cabinet 110.

The drum 120 is rotatably provided in the tub 120, and laundry is introduced into the drum 130 through the door 113, and is contained therein. The drum 130 is provided therethrough with a plurality of through holes (not shown) through which washing water flows. The drum 130 is provided therein with a plurality of lifters (not shown), which lifts and drops laundry contained in the drum 130 while the drum 130 is rotated, whereby the movement of the laundry due to the lifters improves the washing performance.

A balancer (not shown) is provide ahead of or behind the drum 130 so as to compensate for disequilibrium caused by laundry during rotation of the drum 130. A rotating shaft (not shown) connected to the drive motor 219*a* and a spider (not shown) connected to the rotating shaft may be provided behind the drum 130.

The water supply unit 140 may include a water supply hose (not shown), which is positioned at an upper level of the inside of the cabinet 110 and through which water is supplied into the tub 120 from an external water source, a water supply valve (not shown), which is provided at the water supply hose so as to control flow of water, and a detergent supply 142, which contains detergent such that the water supplied through the water supply hose is introduced into the tub 120 together with the detergent. Here, the detergent supply 142 may be connected to the tub 120 via a water supply bellows 144.

The water discharge unit 150 includes a water discharge bellows, which is positioned at a lower level of the inside of the cabinet 110 and through washing water that is used in washing and rinsing in the tub 120 is discharged to the outside, a water discharge pump (not shown) configured to discharge the washing water, discharged from the water discharge bellows, under pressure, and a water discharge hose (not shown) configured to guide the washing water that is discharged by the water discharge pump toward a water discharge port.

The air supply unit 200 is provided at the upper portion of the tub 120, and circulates and heats the air in the tub 120 during a drying procedure of the laundry treatment apparatus 100. In other words, the air supply unit 200 is configured so as to such the air in the tub 120, heat the air, and introduce the air into the tub 120.

The air supply unit 200 includes a fan duct 210, which is provided at an air collection port (not shown) formed in an outer circumferential surface of the rear portion of the tub 120, a heating duct 220 configured to heat and guide the air that has passed through the fan duct 210, a supply duct 250 configured to supply the air that is heated by the heating duct 220 in a forward direction of the tub 120.

Hereinafter, the air supply unit 200 according to an embodiment of the present disclosure is described in detail with reference to FIGS. 3 and 4.

Figure 3:
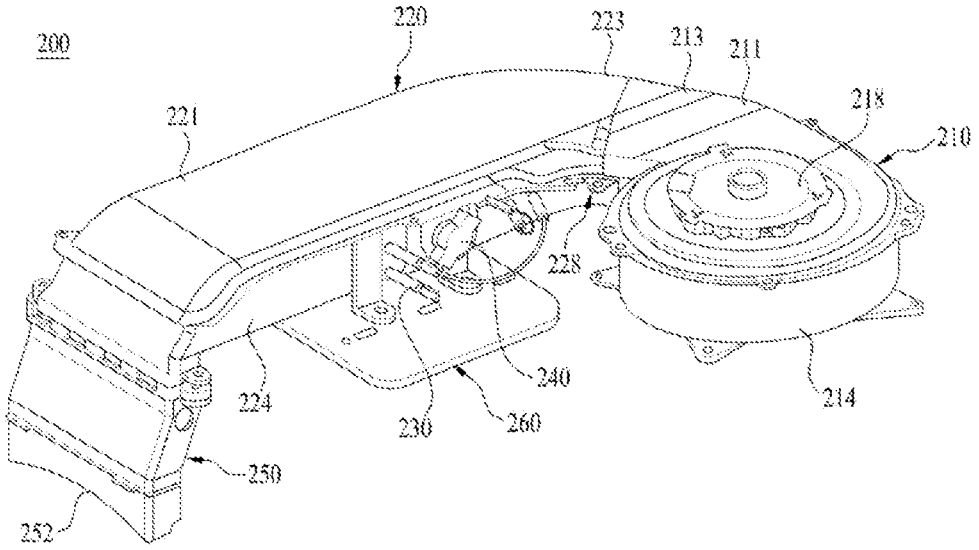
FIG. 3 is a perspective view illustrating an air supply unit according to an embodiment of the present disclosure.
Figure 4:
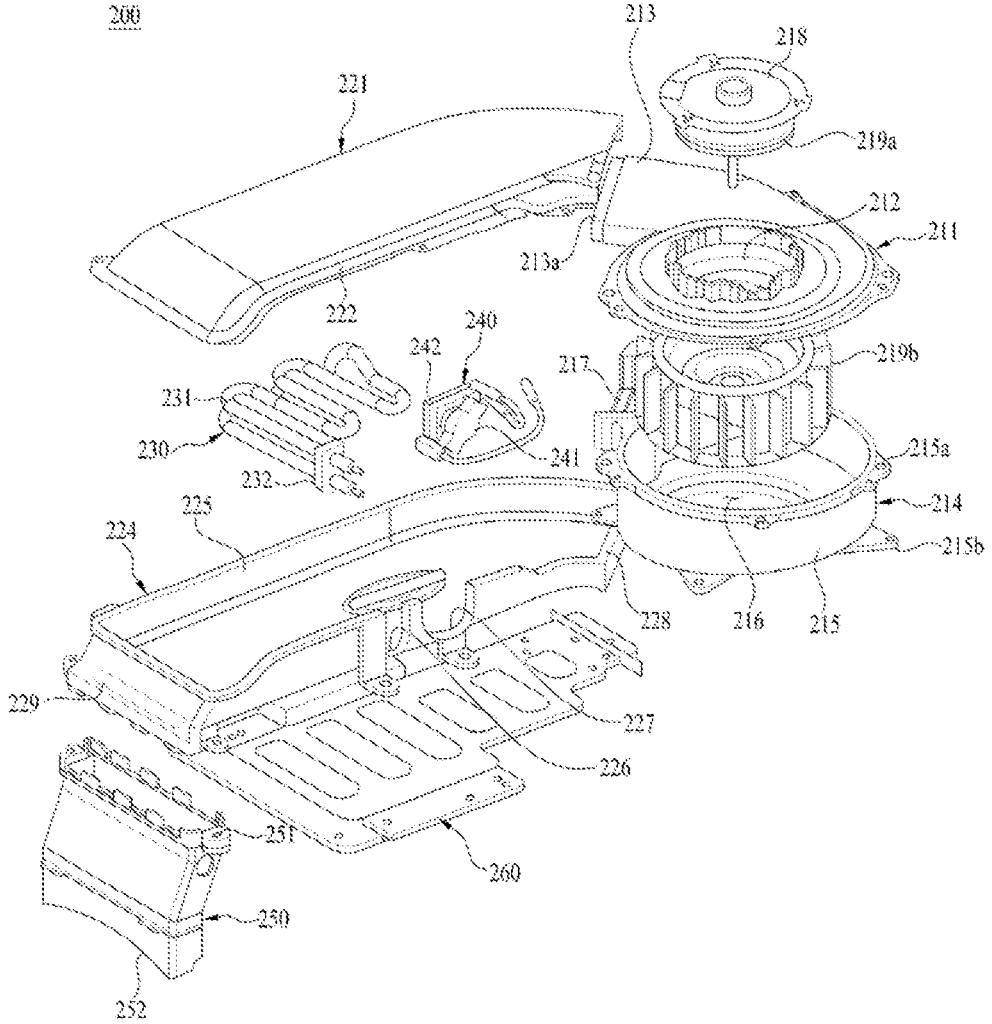
FIG. 4 is an exploded perspective view illustrating the air supply unit according to an embodiment of the present disclosure.

FIG. 3 is a perspective view illustrating the air supply unit 200 according to the embodiment of the present disclosure. FIG. 4 is an exploded perspective view illustrating the air supply unit 200 according to the embodiment of the present disclosure.

As illustrated in the drawings, the air supply unit 200 according to the embodiment of the present disclosure may be broadly composed of the fan duct 210, the heating duct 220, and the supply duct 250. Here, the ducts 210, 220 and 25 may be coupled to one another so as to allow air to flow therethrough.

Accordingly, it is possible to embody the air supply unit 200 by selectively changing the fan duct 210, the heating duct 220, and the supply duct 250 depending on the size of the tub 120 coupled to the air supply unit 200 or the blowing capacity of the air supply unit 200. For example, it is possible to embody the air supply unit 200 by changing the heating duct 220 or the supply duct 250 in response to change in the size of the tub 120 and by changing the fan duct 210 in response to change in the capacity (that is, the blowing capacity) of the air supply unit 200.

Specifically, when the size of the tub 120 is changed, the length and the diameter of the tub 120 may be increased or decreased. When the length of the tub 120 is changed, it is possible to embody using the heating duct 220 corresponding to the changed length of the tub 120. When the diameter of the tub 120 is changed, it is possible to embody the air supply unit 200 using the supply duct 250 corresponding to the changed diameter of the tub 120.

Furthermore, when the capacity of the air supply unit 200 is changed, the blowing capacity of the air supply unit 200 may be increased or decreased. In order to increase the blowing capacity of the air supply unit 200, it is possible to embody the air supply unit 200 by changing the fan duct 210 in which a blowing fan 219*b* is provided.

In other words, according to the present disclosure, it is possible to embody the air supply unit 200 by modularizing the fan duct 210, the heating duct 220, and the supply duct 250, which constitute the air supply unit 20, and selectively combining the fan duct 210, the heating duct 220, and the supply duct 250 according to the size of the tub 120 or the blowing capacity of air supply unit 200.

In order to prevent the heat generated by the heating duct 220 from being directly transmitted to the tub 120, a radiating plate 260 may be provided between the heating duct 220 and the tub 120. The radiating plate 260 may be formed of a metal material having a predetermined thickness, and may be configured to have one of various forms depending on the form of the tub 120 and the form of the heating duct 220.

The supply duct 250 is configured to guide the air heated in the heating duct 220 in a forward direction of the tub 120. The supply duct 250 is provided at the upper end thereof with a heating duct coupler 251 connected to a supply duct coupler 229*a* so as to allow an air supply port 229 of the heating duct 220 to communicate with the supply duct 250, and is provided at the lower end thereof with a tub connector 252 connected to the rim 121*a* of the tub 120. The supply duct 250 may be curved at a predetermined angle according to the shape of the front portion of the tub 120.

Hereinafter, the fan duct 210 will be described in detail with reference to FIGS. 4 and 5.

Figure 5:
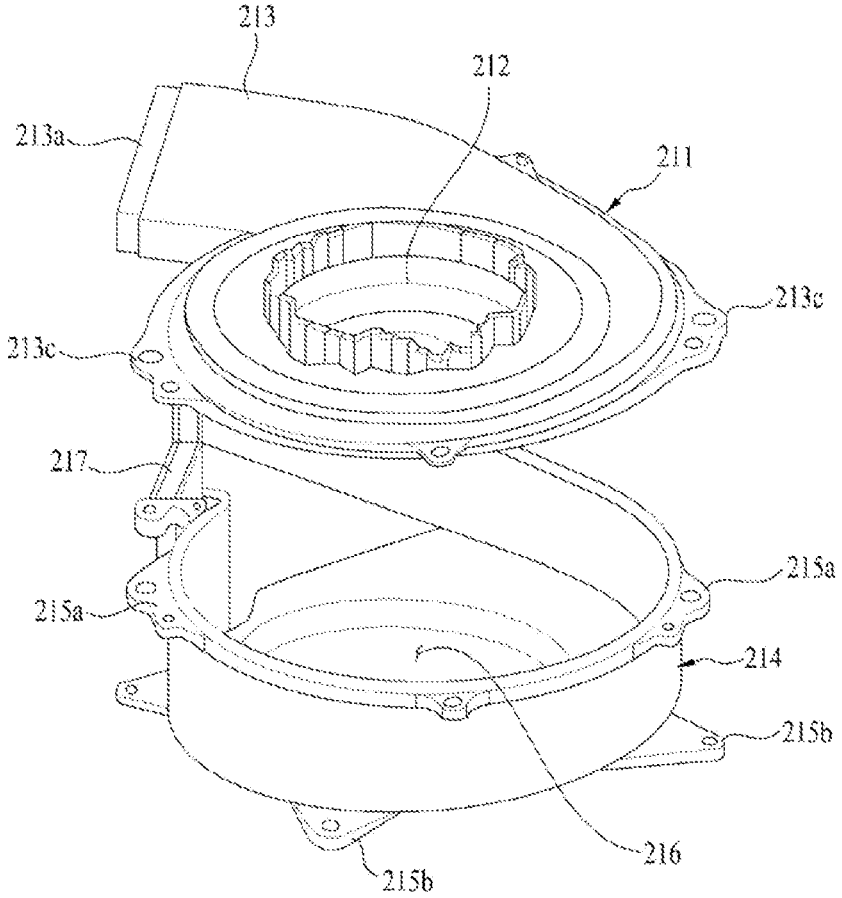
FIG. 5 is an exploded perspective view illustrating a fan duct of the air supply unit according to an embodiment of the present disclosure.

FIG. 5 is an exploded perspective view illustrating the fan duct 210 of the air supply unit 200 according to an embodiment of the present disclosure.

As illustrated in the drawings, the fan duct 210 includes a lower fan duct 214 seated on and coupled to the air collection port formed in the tub 120, an upper fan duct 211 coupled to the lower fan duct 214 so as to define a space for rotation of the blowing fan 219*b*, and a motor housing 218, which is coupled to the upper fan duct 211 and on which the drive motor 219*a* configured to rotate the blowing fan 219*b* is mounted.

The upper fan duct 211 is provided in the center thereof with a motor housing mount recess 212 in which the motor housing 218 is inserted and coupled, and is provided on the outer circumferential surface thereof with a lower fan duct coupler 213*c*, which is to be coupled to the lower fan duct 214 by means of an additional fastening member (not shown).

The upper fan duct 211 is provided at one side thereof with an upper outflow port 213, to which the heading duct 220 is connected, so as to allow the air sucked by the blowing fan 219*b* to flow into the heating duct 220. The upper outflow port 213 is provided with a sealing step 213*a*, which is fitted into an upper heating duct 221 of the heating duct 220, which will be described later. An upper seal 213*b* is interposed between the sealing step 213*a* and the upper heating duct 221. The sealing step 213*a* and the upper seal 213*b* will be described in detail with reference to other drawings.

The fan duct 214 is seated in and secured to the air collection port formed in the tub 120 such that the air in the tub 120 is introduced through the air collection port. The lower fan duct 214 is provided in the center thereof with a through hole 126, which communicates with the air collection port, and is provided on the outer circumferential surface thereof with a fan housing 215 defining therein a space in which the blowing fan 219*b* is rotatable.

An upper portion of the outer circumferential surface of the fan housing 215 is provided with an upper fan duct coupler 215*a*, which is coupled to the lower fan duct coupler 213*c* of the upper fan duct 211, and a lower portion of the outer circumferential surface of the fan housing 215 is provided with an air collection port coupler 215*b*, which is coupled to the air collection port.

The lower fan duct 214 is provided at a side thereof with a lower outflow port 217 connected to the heating duct 220, so as to allow the air sucked by the blowing fan 219*b* to flow into the heating duct 220. The upper outflow port 213 is provided with a sealing groove 217*a* into which a lower heating duct 224 of the heating duct 220 is inserted, which will be described later, and a lower seal 217*b* is interposed between the sealing groove 217*a* and the lower hating duct 224. The sealing groove 217*a* and the lower seal 217*b* will be described in detail with reference to other drawings.

The motor housing 218, to which the motor 219*a* configured to rotate the blowing fan 219*b* is coupled, is coupled in the motor housing mount recess 212 in the upper fan duct 211. The motor housing 218 is provided on the lower surface thereof with the motor 219*a* configured to rotate the blowing fan 219*b*, and the blowing fan 219*b* is coupled to the rotating shaft of the motor 219*a*.

The upper outflow port 213 or the lower outflow port 217 of the fan duct 210 is provided at one side thereof with a first rotatable coupler 210*a* and at the opposite side thereof with a first fixed coupled 210*b*. The first rotational coupler 210*a* and the first fixing coupler 210*b* are respectively coupled to a second rotatable coupler 220*a* and a second fixing coupler

220*b* provided at the heating duct 220, which will be described later, so as to fix the fan duct 210 to the heating duct 220

Here, the first rotatable coupler 210*a* projects toward the heating duct 220 from one side of the combined outflow port 213 and 217 of the fan duct 210, and is configured to have the form of a rib which is flat parallel to the direction in which the fan duct 210 is coupled to the heating duct 220. The first rotatable coupled 210*a* is coupled to the second rotatable coupler 220*a* such that the fan duct 210 is rotatable relative to the heating duct 220 in the state of being supported thereby.

The first fixing coupler 210*b* is formed from the opposite side of the combined outflow port 213 and 217 of the fan duct 210 in an outward direction of the fan duct 210 parallel to the combined outflow port 213 and 217. In other words, the first fixing coupler 210*b* may extend in a radial direction of a circle defined about the first rotatable coupler 210*a*, and may be configured to have the form of a rib having a flat surface flush with the plane defined by the combined outflow port 213 and 217.

The coupling between the fan duct 210 and the heating duct 220 by means of the first rotatable coupler 210*b* and the first fixing coupler 210*b* will be described in detail with reference to other drawings after completion of the description of the heating duct 220.

Hereinafter, the heating duct 220 will be described in detail with reference to FIGS. 4 and 6.

Figure 6:
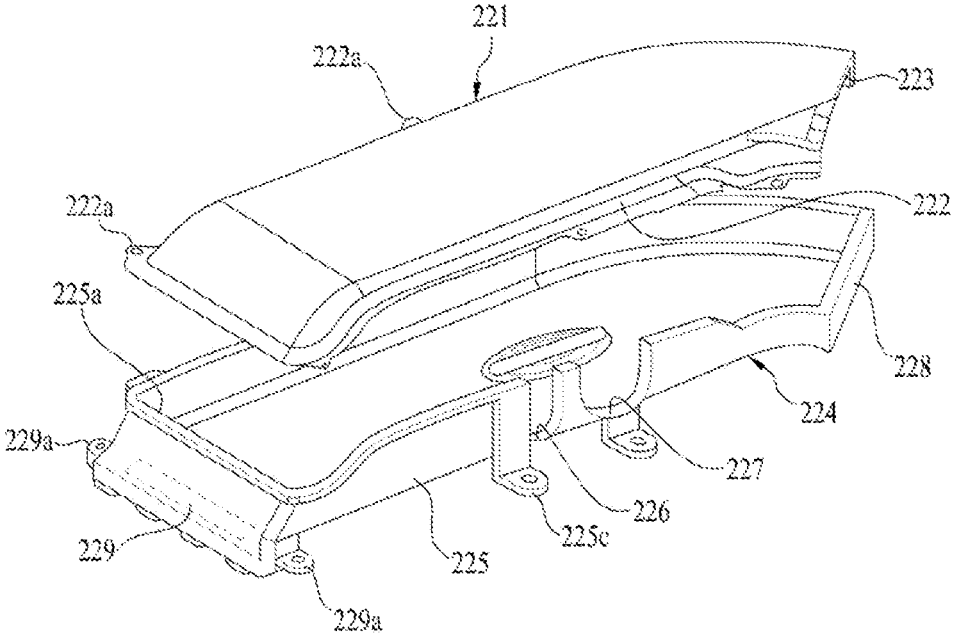
FIG. 6 is a side perspective view illustrating a heating duct of the air supply unit according to an embodiment of the present disclosure.

FIG. 6 is an exploded perspective view illustrating the heating duct 220 of the air supply unit 200 according to an embodiment of the present disclosure.

As illustrated in the drawings, the heating duct 220 may include an upper heating duct 221 defining the upper surface of the heating duct 220, a lower heating duct 224 coupled to the upper heating duct 221 so as to define a space for flow of air and for heating, a heater unit 230 disposed in the heating duct 220 so as to heat flowing air, and a sensor unit 240 disposed in the heating duct 220 so as to detect a temperature of air heated by the heater unit 230.

The lower heating duct 224 is configured to have the form of a box, which has a lower wall 225 formed along the outer circumference thereof and is open upwards, and the upper heating duct 221 is coupled to the upper portion of the lower wall 225 of the lower heating duct 224 so as to define a passage for flow of air and for heating.

The upper surface of the lower wall 225 is provided therealong with a sealing groove 225*a* into which a seal 225*b* is fitted. By virtue of the seal 225*b* fitted into the sealing groove 225*a*, it is possible to prevent heated air from leaking when the lower heating duct 224 is coupled to the upper heating duct 221.

A side of the lower wall 225 is provided with a depressed heater coupler 226, in which the heater unit 230 is coupled, and a depressed sensor coupler 227, in which the sensor unit is coupled. The heater coupler 226 and the sensor coupler 227 will be described in detail with reference to other drawings.

The upper portion of the outer circumferential surface of the lower wall 225 is provided with an upper heating duct coupler 225*d*, which projects therefrom and to which the upper heating duct 221 is coupled. The lower portion of the lower wall 225 is provided with a radiating plate coupler 225*c*, which projects therefrom and to which the radiating plate 260 is coupled.

An air supply port 229 is formed in the lower portion of the front portion of the lower heating duct 224 so as to guide air to the supply duct 250. The air supply port 229 is provided at the outer surface thereof with a supply duct coupler 229*a*, to which the supply duct 250 is coupled.

The rear portion of the lower heating duct 2240 is provided with a lower inflow port 228, which is configured so as to correspond to the lower outflow port 217 of the lower fan duct 214 and into which the air in the fan duct 210 is introduced. The end of the lower inflow port 228 is provided with a press step 228*a*, which is fitted into the sealing groove 217*a* in the lower fan duct 214 and presses the lower seal 217*b* disposed in the sealing groove 217*a*.

The upper heating duct 221 is seated on the lower wall 225 of the lower heating duct 224 so as to define a passage through which air flows. The upper heating duct 221 may be configured to the form of a plate having such a predetermined surface area as to cover the lower heating duct 224.

The outer circumferential surface of the upper heating duct 221 is provided with a lower heating duct coupler 222*a*, which is coupled to the upper heating duct coupler 225*d* formed at the lower wall 225 via an additional fastening member. The outer circumferential surface of the lower portion of the upper heating duct 221 is provided with an upper coupling surface 222*b*, which presses the seal 225*b* disposed in the sealing groove 225*a* in the lower wall 225.

The rear portion of the upper heating duct 221 may be provided with an upper inflow duct 223 corresponding to the upper outflow port 213 of the upper fan duct 211. The upper inflow port 223 may be formed so as to have a shape correspond to the shape of the sealing step 213*a* such that the sealing step 213*a* of the upper fan duct 211 is fitted into the upper inflow port 223.

The upper inflow port 223 is provided on the lower surface thereof with a press surface 223*a* configured to press the upper seal 213*b* interposed between the upper inflow port 223 and the sealing step 213*a*. Because the press surface 223*a* presses the upper seal 213*b*, the sealing state between the upper inflow port 223 and the sealing step 213*a* may be maintained.

One side of the upper inflow port 223 or the lower inflow port 228 of the heating duct 220 is provided with the second rotatable coupler 220*a*, which is coupled to the first rotatable coupler 210*a*, and the other side of the upper inflow port 223 or the lower inflow port 228 of the heating duct 220 is provided with the second fixing coupler 220*b*, which is coupled to the first fixing coupler 210*b*.

Here, the second rotatable coupler 220*a* projects toward the fan duct 210 from the one side of the combined inflow port 223 and 228 of the heating duct 220, and is configured to have the form of a rib having a flat surface parallel to a direction in which the fan duct 210 is coupled to the heating duct 220. Because the second rotatable coupler 220*a* is coupled to the first rotatable coupler 210*a*, it is possible to support the fan duct 210 in the state of being rotatable relative to the heating duct 220.

The second fixing coupler 220*b* is formed so as to extend from the other side of the combined inflow port 223 and 228 of the heating duct 220 in an outward direction of the heating duct 220 parallel to the combined inflow port 223 and 228. In other words, the second fixing coupler 220*b* may be formed so as to extend in a radial direction of a circle defined about the second rotatable coupler 220*a*, and may be configured to have the form of a rib having a flat surface flush with the plane defined by the combined outflow port 213 and 217.

The coupling between the fan duct 210 and the heating duct 220 by means of the second rotatable coupler 220*a* and the second fixing coupler 220*b* will be described in detail with reference to other drawings after completion of the description of the heating duct 220.

Hereinafter, the mounting of the heater unit 230 and the sensor unit 240 will be described in detail with reference to FIGS. 4 and 7.

Figure 7:
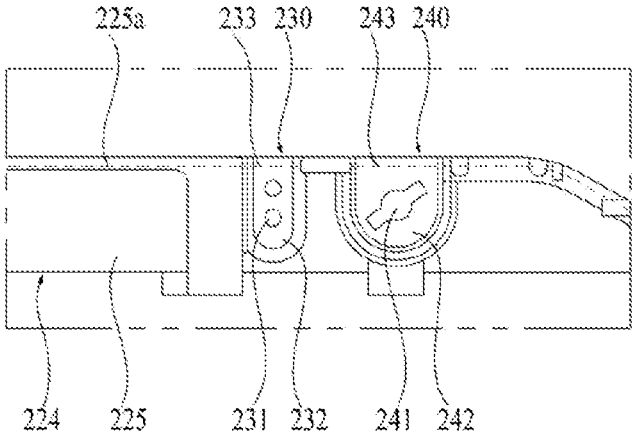
FIG. 7 is a side view illustrating the mounted state of a heater unit and a sensor unit according to an embodiment of the present disclosure.

FIG. 7 is a side view illustrating the mounted state of the heater unit 230 and the sensor unit 240 according to an embodiment of the present disclosure.

The heater unit 230 includes a heater coil 231, which is bent in a zigzag fashion in the heating duct 220 and heat the air flowing in the heating duct 220, and a heater bracket 232, to which the heater coil 231 is fixed and which is inserted into the heater coupler 226 so as to support and hold the heater coil 231 with respect to the heat duct 220.

The heater coil 231 may be configured so as to have any of various forms. Typically, the heater coil 231 may extend in a zigzag fashion in a direction intersecting the direction of the air flowing in the heating duct 220.

The heater bracket 232 is inserted and coupled in the heater coupler 226 formed in the lower wall 225 so as to support the heater coil 231 in the space in the heating duct 220 through which air flows. The heater bracket 232 may be configured to have a shape corresponding to the shape of the heater coupler 226, and the upper surface of the heater bracket 232 may be provided therein with an extending groove 233, which extends in a line with respect to the sealing groove 225 formed in the lower wall 225.

The extending groove 233 may be formed so as to be connected to the sealing groove 225*a* in the lower wall 225 and to extend therefrom. The seal 225*b* interposed between the upper heating duct 221 and the lower heating duct 224*s* may be continuously inserted into the sealing groove 225*a* and the extending groove 233 so as to maintain the sealing state. In other words, the continuous groove may be formed in the sealing groove 225*a* and the extending groove 233, and the seal 225*b* interposed between the upper heating duct 221 and the lower heating duct 224 is capable of improving the sealing ability.

The sensor unit 240 includes a sensor extending into the heating duct 220 and detecting the temperature of the air in the heating duct 220, and a sensor bracket 242, to which the sensor 241 is fixed and which is inserted into the sensor coupler 227 so as to support and hold the sensor 241 with respect to the heating duct 220.

The sensor 241 may be embodied as any of various kinds of temperature sensors. Typically, the sensor 241 may be formed so as to extend in a direction intersecting a direction of the air flowing in the heating duct 220.

The sensor bracket 242 may be inserted and coupled in the sensor coupler 227 formed in the lower wall 225 and may be held therein so as to support the sensor 241 in the space in which the air in the heating duct 220 flows. The sensor bracket 242 may be formed so as to have a shape corresponding to the shape of the sensor coupler 227, and the upper surface of the sensor bracket 242 may be provided therein with an extending groove 243, which is connected to the sealing groove 225*a* formed in the lower wall 225 and extends therefrom.

The extending groove 243 may be formed so as to be connected to the sealing groove 225*a* in the lower wall 225 and to extend therefrom. The seal 225*b* interposed between the upper heating duct 221 and the lower heating duct 224 may be continuously inserted into the sealing groove 225*a* and the extending groove 243 so as to establish sealing state therebetween. In other words, the extending groove 243 may be connected to the sealing groove 225*a* so as to form a continuous groove to thus form a sealing state, and the seal 225*b* interposed between the upper heating duct 221 and the lower heating duct 224 may be inserted into both the sealing groove 225*a* and the extending groove 243 so as to improve sealing ability.

Hereinafter, the coupling between the fan duct 210 and the heating duct 220 will be described in detail with reference to FIGS. 8 to 11.

Figure 8:
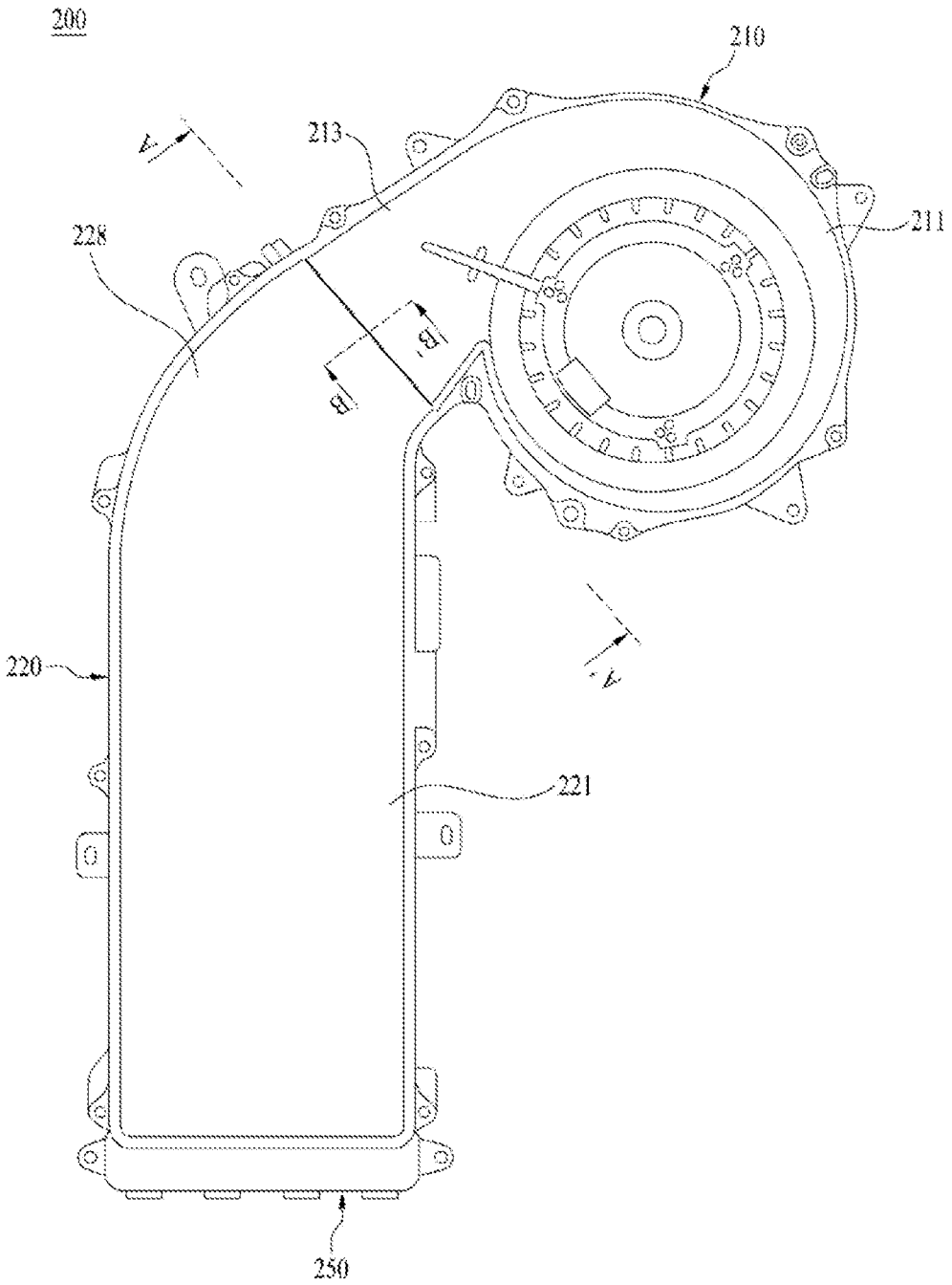
FIG. 8 is a plan view illustrating the mounted state of the air supply unit according to an embodiment of the present disclosure.
Figure 9:
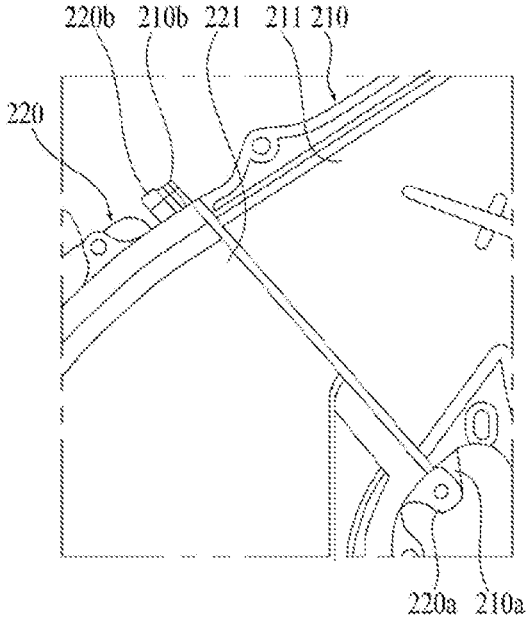
FIG. 9 is a fragmentary enlarged view illustrating the coupled state of the heating duct and the fan duct according to an embodiment of the present disclosure.

FIG. 8 is a plan view illustrating the mounted state of the air supply unit 200 according to an embodiment of the present disclosure. FIG. 9 is a fragmentary enlarged view illustrating the coupled state between the heating duct 220 and the fan duct 210 according to an embodiment of the present disclosure.

As illustrated in the drawings, the air supply unit 200 according to an embodiment of the present disclosure may define an air circulation passage by coupling the fan duct 210 to the heating duct 220.

The fan duct 210 and the heating duct 220 may be coupled to each other by coupling the first rotatable coupler 210*a* formed in the fan duct 210 to the second rotatable coupler 220*a* formed in the heating duct 220 and then coupling the first fixing coupler 210*b* to the second fixing coupler 220*b*.

Here, each of the first rotatable coupler 210*a* and the second rotatable coupler 220*a* may be configured to have the form of a rib having a flat surface parallel to a direction in which the fan duct 210 is coupled to the heating duct 220 (or in a direction in which air flows). The first rotatable coupler 210*a* and the second rotatable coupler 220*a* may be rotatably coupled to each other such that the first rotatable coupler 210 and the second rotatable coupler 220*a* are rotatable relative to each other about a fastening member inserted thereinto.

The first rotatable coupler 210*a* and the second rotatable coupler 220*a* may be coupled to each other in the state in which the combined outflow port 213 and 217 of the fan duct 210 and the combined outflow port 223 and 228 of the heating duct 220 are opened about the first rotatable coupler 210*a* and the second rotatable coupler 220*a* at a predetermined angle.

After the first rotatable coupler 210*a* is coupled to the second rotatable coupler 220*a*, the fan duct 210 is rotated relative to the heating duct 220 about the first rotatable coupler 210*a* and the second rotatable coupler 220*a* such that the combined outflow port 213 and 217 of the fan duct 210 come into contact with the combined inflow port 223 and 228 of the heating duct 220.

Here, when the fan duct 210 is rotated toward the heating duct 220, the first fixing coupler 210*b* of the fan duct 210 comes into contact with the second fixing coupler 220*b* of the heating duct 220. The first fixing coupler 210*b* and the second fixing coupler 220*b* are formed so as to be respectively parallel to the combined outflow port 213 and 217 and the combined inflow port 223 and 228. The first fixing coupler 210*b* and the second fixing coupler 220*b* are coupled to each other by means of an additional fastening member (not shown), which is inserted into in a direction parallel to a rotational direction of the fan duct 210.

Figure 10:
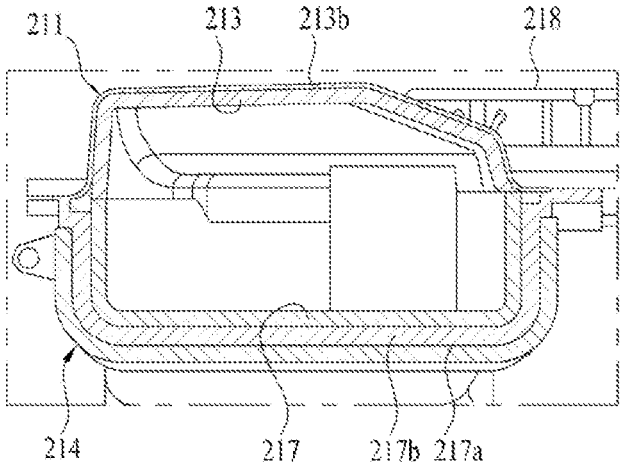
FIG. 10 is a cross-sectional view taken along line A-A' in FIG. 8.

Upon the coupling between the fan duct 210 and the heating duct 220, the seals 213*b* and 217*b* are respectively inserted into the sealing step 213*a* of the upper outflow port 213 of the fan duct 210 and the sealing groove 217*a* of the lower outflow port 217 of the fan duct 210 and are attached thereto, as illustrated in FIG. 10.

Figure 11:
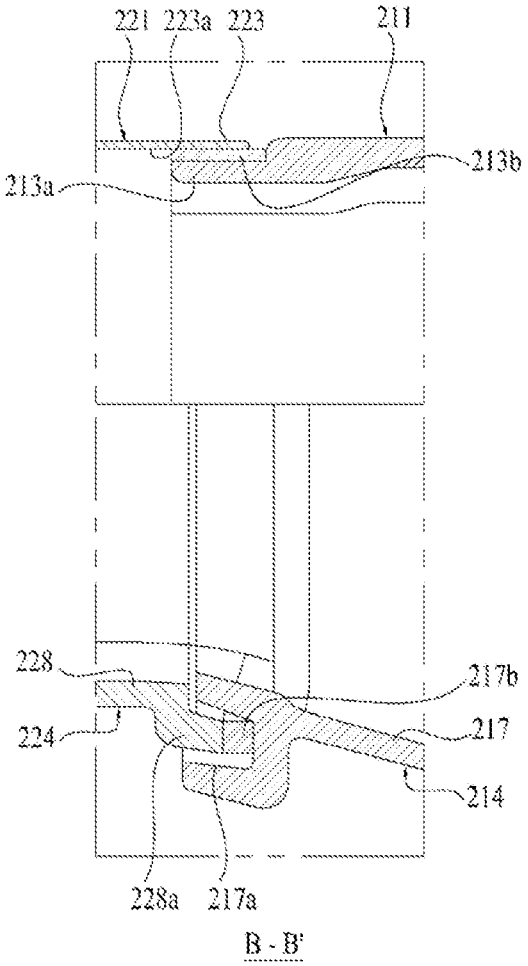
FIG. 11 is a cross-sectional view taken along line B-B' in FIG. 8.

When the fan duct 210 is rotated toward the heating duct 220 and the combined outflow port 213 and 217 of the fan duct 210 comes into contact with the combined inflow port 223 and 228 of the heating duct 220, the upper seal 213*b* of the upper outflow port 213 is inserted downwards into the upper inflow port 223 of the upper heating duct 221 and is pressed by the press surface 223*a* of the upper inflow port 223, thus creating a sealed state therebetween, and the lower seal 217*b* inserted into the sealing groove 217*a* in the lower outflow port 217 is pressed by the press step 228*a* of the lower heating duct 224, thus creating a sealed state therebetween, as illustrated in FIG. 11.

As described above, because the structure of the air supply unit 200 according to an embodiment of the present disclosure is composed of the fan duct 210, the heating duct 220, and the supply duct 250, which are modularized, it is possible to embody the air supply unit 200 by selectively changing the fan duct 210, the heating duct 220, and the supply duct 250 depending on the size of the tub 120 or the blowing capacity of the air supply unit 220.

Specifically, when the size of the tub 120 is changed, the length and the diameter of the tub 120 may be increased or decreased. Here, when the length of the tub 120 is changed, it is possible to embody the air supply unit 200 using the heating duct 220 corresponding to the length of the tub 120. Meanwhile, when the diameter of the tub 120 is changed, it is possible to embody the air supply unit 200 using the supply duct 250 corresponding to the diameter of the tub 120.

Furthermore, when the capacity of the air supply unit 200 is changed, the blowing capacity of the air supply unit 200 may be increased or decreased. In order to increase the blowing capacity of the air supply unit 200, the fan duct 210 equipped with the blowing fan 219*b* may be changed.

Although preferred embodiments of the present disclosure have been described in detail, those skilled in the art to which the present disclosure belongs will appreciate that the present disclosure can be implemented in various modifications within the idea and scope of the present disclosure, which is defined by the accompanying claims. Accordingly, the various modifications of the present disclosure falls within the scope of the present disclosure.

According to the laundry treatment apparatus according the present disclosure, there is an effect of providing a laundry treatment apparatus equipped with a duct capable of corresponding to tubs having various sizes by improving the structure of an air supply unit provided at a combined drying and washing machine.

Furthermore, according to the laundry treatment apparatus according the present disclosure, there is an effect of providing a laundry treatment apparatus equipped with a duct capable of corresponding to tubs having various sizes by separately modularizing a heat and a blowing fan of an air supply unit provided at a combined drying and washing machine.

The effects of the present disclosure are not limited to the above-mentioned effects, and other effects of the present disclosure, which are not mentioned above, will be clearly understood to those skilled in the art from the following descriptions.

What is claimed is:

1. A laundry treatment apparatus comprising:
- a cabinet that defines an outer appearance of the laundry treatment apparatus;
- a tub disposed in the cabinet;
- a drum rotatably disposed in the tub; and
- an air supply unit configured to heat and circulate air in the tub, the air supply unit comprising:
  - a fan duct coupled to the tub and configured to receive the air from the tub,
  - a heating duct coupled to the fan duct and fixed to an upper portion of the tub, the heating duct being configured to heat the air supplied from the fan duct and to guide the air in a forward direction of the tub, and
  - a supply duct coupled to the heating duct and configured to supply the air guided by the heating duct to a front portion of the tub,
- wherein the fan duct comprises:
  - an outflow port configured to guide the air toward the heating duct, and
  - a first coupler disposed at an outer side of the outflow port,
- wherein the heating duct comprises:
  - an inflow port coupled to the outflow port of the fan duct, and
  - a second coupler disposed at an outer side of the inflow port and coupled to the first coupler, and
- wherein the first and second couplers couple the fan duct and the heating duct to each other to thereby define an air path between the fan duct and the heating duct.

2. The laundry treatment apparatus of claim 1, wherein the first coupler comprises:
- a first rotatable coupler that is disposed at a first side of the outflow port and has a flat surface parallel to a direction in which the fan duct is coupled to the heating duct; and
- a first fixing coupler that is disposed at a second side of the outflow port and has a flat surface parallel to a surface of the outflow port.

3. The laundry treatment apparatus of claim 2, wherein the second coupler comprises:
- a second rotatable coupler that is disposed at a first side of the inflow port and has a flat surface parallel to the direction in which the fan duct is coupled to the heating duct, the second rotatable coupler being rotatably coupled to the first rotatable coupler; and
- a second fixing coupler that is fixed to the first fixing coupler and has a flat surface parallel to a surface of the inflow port.

4. The laundry treatment apparatus of claim 1, wherein the air supply unit further comprises:
- a blowing fan configured to blow the air toward the supply duct; and
- a motor configured to provide rotational force to the blowing fan, and
- wherein the fan duct comprises:
  - a lower fan duct that is coupled to the tub and receives the blowing fan, and
  - an upper fan duct that is coupled to an upper portion of the lower fan duct and receives the motor.

5. The laundry treatment apparatus of claim 4, wherein the heating duct comprises:
- a lower heating duct that is fixed to an upper surface of the tub and has an open upper surface; and
- an upper heating duct that is mounted on the lower heating duct to thereby define an air passage in the heating duct.

6. The laundry treatment apparatus of claim 5, wherein the outflow port comprises a lower outflow port disposed at the lower fan duct and an upper outflow port disposed at the upper fan duct, and
- wherein the inflow port comprises:
  - a lower inflow port that is disposed at the lower heating duct and in contact with the lower outflow port, and
  - an upper inflow port that is disposed at the upper heating duct and in contact with the upper outflow port.

7. The laundry treatment apparatus of claim 6, wherein the air supply unit further comprises a lower seal disposed between the lower fan duct and the lower heating duct, wherein the lower fan duct defines a sealing groove at an end of the lower outflow port, the sealing groove extending along the end of the lower outflow port and accommodating the lower seal, and wherein the lower heating duct comprises a press step disposed at an end of the lower inflow port and inserted into the sealing groove to press the lower seal.

8. The laundry treatment apparatus of claim 6, wherein the upper fan duct comprises a sealing step disposed at an upper surface of the upper outflow port and inserted into the upper inflow port, wherein the air supply unit further comprises an upper seal disposed between the upper fan duct and the upper heating duct and attached to the sealing step, and wherein the upper heating duct further comprises a press surface disposed at a lower surface of the upper inflow port and configured to press the upper seal.

9. The laundry treatment apparatus of claim 5, wherein the air supply unit further comprises a heater unit disposed in the heating duct and configured to heat the air supplied from the fan duct, and wherein the lower heating duct comprises a lower wall that defines a lower portion of the air passage of the heating duct, the lower wall defining a heater coupler that supports the heater unit.

10. The laundry treatment apparatus of claim 9, wherein the heater unit comprises:

a heater bracket that is inserted into and fixed to the heater coupler; and a heater coil that is supported by the heater bracket and extends into the air passage of the heating duct.

11. The laundry treatment apparatus of claim 10, wherein the air supply unit further comprises a seal disposed between the lower heating duct and the upper heating duct, wherein the lower wall defines a sealing groove at an upper surface thereof, the sealing groove accommodating a portion of the seal, and wherein the heater bracket defines an extending groove at an upper surface thereof, the extending groove extending from the sealing groove and receiving another portion of the seal.

12. The laundry treatment apparatus of claim 5, wherein the air supply unit further comprises a sensor unit configured to detect a temperature of the air in the heating duct, and wherein the lower heating duct comprises a lower wall that defines a lower portion of the air passage of the heating duct, the lower wall defining a sensor coupler that supports the sensor unit.

13. The laundry treatment apparatus of claim 12, wherein the sensor unit comprises:

a sensor bracket inserted into and fixed to the sensor coupler; and a sensor that is supported by the sensor bracket and extends into the air passage of the heating duct.

14. The laundry treatment apparatus of claim 13, wherein the air supply unit further comprises a seal disposed between the lower heating duct and the upper heating duct, wherein the lower wall defines a sealing groove at an upper surface thereof, the sealing groove accommodating a portion of the seal, and wherein the sensor bracket defines an extending groove at an upper surface thereof, the extending groove extending from the sealing groove and receiving another portion of the seal.

15. A laundry treatment apparatus comprising:

a cabinet that defines an outer appearance of the laundry treatment apparatus;

a tub disposed in the cabinet;

a drum rotatably disposed in the tub; and an air supply unit configured to heat and circulate air in the tub, the air supply unit comprising:

a fan duct coupled to the tub and configured to receive the air from the tub, a heating duct coupled to the fan duct and fixed to an upper portion of the tub, the heating duct being configured to heat the air supplied from the fan duct and to guide the air in a forward direction of the tub, a supply duct coupled to the heating duct and configured to supply the air to a front portion of the tub, a blowing fan disposed in the fan duct and configured to blow the air toward the supply duct, and a motor configured to provide rotational force to the blowing fan, wherein the fan duct comprises:

a lower fan duct that is coupled to the tub and accommodates the blowing fan, and an upper fan duct that is coupled to an upper portion of the lower fan duct and accommodates the motor, and wherein the heating duct comprises:

a lower heating duct that is fixed to an upper surface of the tub and has an open upper surface, and an upper heating duct mounted on the lower heating duct to thereby define an air passage in the heating duct.

16. The laundry treatment apparatus of claim 15, wherein the fan duct comprises an outflow port configured to guide the air toward the heating duct, wherein the heating duct comprises an inflow port coupled to the outflow port of the fan duct, wherein the outflow port comprises a lower outflow port disposed at the lower fan duct and an upper outflow port disposed at the upper fan duct, and wherein the inflow port comprises:

a lower inflow port that is disposed at the lower heating duct and in contact with the lower outflow port, and an upper inflow port that is disposed at the upper heating duct and in contact with the upper outflow port.

17. The laundry treatment apparatus of claim 16, wherein the air supply unit further comprises:

a lower seal disposed between the lower fan duct and the lower heating duct; and an upper seal disposed between the upper fan duct and the upper heating duct, wherein the lower fan duct defines a sealing groove at an end of the lower outflow port, the sealing groove extending along the end of the lower outflow port and accommodating the lower seal, wherein the lower heating duct comprises a press step disposed at an end of the lower inflow port and inserted into the sealing groove to press the lower seal, wherein the upper fan duct comprises a sealing step disposed at an upper surface of the upper outflow port and inserted into the upper inflow port, the upper seal being attached to the sealing step, and wherein the upper heating duct comprises a press surface disposed at a lower surface of the upper inflow port and configured to press the upper seal.

18. The laundry treatment apparatus of claim 16, wherein the fan duct further comprises a first coupler disposed at an outer side of the outflow port, wherein the heating duct further comprises a second coupler disposed at an outer side of the inflow port and coupled to the first coupler, wherein the first coupler comprises:

a first rotatable coupler that is disposed at a first side of the outflow port and has a flat surface parallel to a direction in which the fan duct is coupled to the heating duct, and a first fixing coupler that is disposed at a second side of the outflow port and has a flat surface parallel to a surface of the outflow port, and wherein the second coupler comprises:

a second rotatable coupler that is disposed at a first side of the inflow port and has a flat surface parallel to the direction in which the fan duct is coupled to the heating duct, the second rotatable coupler being rotatably coupled to the first rotatable coupler, and a second fixing coupler that is fixed to the first fixing coupler and has a flat surface parallel to a surface of the inflow port.

* * * * *